US007582169B2

(12) United States Patent
Volonte

(10) Patent No.: US 7,582,169 B2
(45) Date of Patent: Sep. 1, 2009

(54) DEVICE AND METHOD FOR CLEANING A POWDER COATING BOOTH

(75) Inventor: Armando Volonte, Valmadrera (IT)

(73) Assignee: J. Wagner AG, Altstätten (CH)

( * ) Notice: Subject to any disclaimer, the term of this patent is extended or adjusted under 35 U.S.C. 154(b) by 489 days.

(21) Appl. No.: 11/091,863

(22) Filed: Mar. 28, 2005

(65) Prior Publication Data

US 2005/0217704 A1 Oct. 6, 2005

(30) Foreign Application Priority Data

Mar. 30, 2004 (IT) ..... MI2004A0632
Mar. 30, 2004 (IT) ..... MI2004A0633

(51) Int. Cl.
*B08B 5/04* (2006.01)
*B05B 15/12* (2006.01)

(52) U.S. Cl. ..... 134/21; 134/22.1; 15/300.1; 15/304; 15/409; 15/416; 118/631; 118/634

(58) Field of Classification Search ..... 134/21, 134/22.11, 22.18; 15/98, 300.1, 304, 409, 15/415.1, 416; 118/309, 326, 306, 316, 626, 118/631, 634, DIG. 7
See application file for complete search history.

(56) References Cited

U.S. PATENT DOCUMENTS

| | | | | | |
|---|---|---|---|---|---|
| 3,800,358 | A | * | 4/1974 | Ryan | 15/312.1 |
| 4,715,314 | A | * | 12/1987 | Ramseier et al. | 118/631 |
| 4,851,261 | A | * | 7/1989 | Gelain et al. | 427/195 |
| 5,346,553 | A | * | 9/1994 | Pingel | 118/309 |
| 5,690,995 | A | * | 11/1997 | Fischli et al. | 427/180 |
| 7,143,464 | B2 | * | 12/2006 | Brosi | 15/306.1 |
| 2005/0217704 | A1 | | 10/2005 | Volonte | |

FOREIGN PATENT DOCUMENTS

| | | |
|---|---|---|
| DE | 195 22 186 A1 | 3/1997 |
| EP | 1 582 267 | 10/2005 |

* cited by examiner

*Primary Examiner*—Michael Barr
*Assistant Examiner*—Saeed T Chaudhry
(74) *Attorney, Agent, or Firm*—Renner, Otto, Boisselle & Sklar, LLP

(57) ABSTRACT

The device according to the invention for cleaning a powder coating booth has a mobile frame, which can be moved along the insides of the booth. The frame includes suction nozzles for sucking off powder residues from the insides of the booth.

14 Claims, 3 Drawing Sheets

DEVICE AND METHOD FOR CLEANING A POWDER COATING BOOTH

TECHNICAL FIELD

The present invention relates to a device and a method for cleaning a powder coating booth as well as a powder coating booth, which is equipped with suction devices for suctioning and cleaning powder residues. The suction devices move along on the inside walls of the booth for this purpose.

RELEVANT ART

As known, the booth cleaning lasts longer in automatic powder coating plants. This slows down the production process and the personnel is exposed to the danger of breathing in harmful substances.

In order to eliminate such disadvantages, an automatic painting system is equipped with a device for the automatic cleaning of the booth from the state of the art DE 195 22 186. Two tube branches are provided for this known painting system that run through the booth into both directions, whereas they blow compressed air on the booth walls when running through it for the first time and remove the powder residues with sponges when running through it for the second time and when returning respectively. However, this cleaning method has some disadvantages. Due to blowing with compressed air, considerable powder quantities are whirled up and distributed in the air, what contributes to the environmental pollution. Moreover, high flow rate suctions are necessary for suctioning the air from the booth in order that the pressure in the booth is always lower than the pressure in the surroundings and the compressed air mixed with powder does not come out from the booth. In addition, a compressor should be used in these cleaning methods. Moreover, a regular maintenance is necessary in order to avoid a blockage of the blowing nozzle. If the powder has a strong adhesive power, sometimes the blowing is not enough in order to guarantee that the powder is removed completely. The result of the blowing depends also on the humidity. If this is very high, the powder becomes moist and as a result difficult to remove, the booth walls are damaged in the long term and get stripes and spots. In this method, the sponges are led by pistons to the walls to be cleaned, wherein the pistons should also be serviced regularly.

SUMMARY OF THE INVENTION

The object of the present invention therefore is to create a device and a method for cleaning the powder coating booth, which eliminates these and even other disadvantages.

The object is solved by a device for cleaning a powder coating booth with the characteristics of claim 1.

The device according to the invention for cleaning a powder coating booth has a mobile frame, which can be moved along the insides of the booth. The frame includes suction nozzles for suctioning powder residue from the insides of the booth.

The object is also solved by a method for cleaning a powder coating booth with the characteristics of claim 13.

In the method according to the invention for cleaning a powder coating booth the air is sucked off through the suction nozzles of the frame, while the frame is moved through the booth.

Advantageous further developments of the invention result from the characteristics stated in the dependent patent claims.

In an embodiment of the device according to the invention, the suction nozzles are arranged in such a way and the frame is built in such a way that the air is accelerated directly at the surface of the inside of the booth. As a result the insides of the booth can be freed even better from powder residues.

In another embodiment of the device according to the invention, the frame has a wiper strip. This too helps in freeing the insides of the booth even better from powder residues.

Moreover it is of advantage, if in the device according to the invention the suction nozzles are arranged on those sides of the frame, which are assigned to the ceiling, the sidewalls and the bottom of the booth. Consequently the ceiling, the sidewalls and the bottom of the booth can be cleaned at the same time in one operation.

In a further development of the device according to the invention, a stationary suction chamber is provided, which is connected via a suction channel to the frame.

In another embodiment of the device according to the invention, the suction chamber includes a movable band with an opening, into which the suction channel leads.

In addition, in the device according to the invention the frame can have a hollow space inside it, which is connected to the suction channel.

For solving the task it is also recommended to provide the frame with a slit at the top. This has the advantage that the frame does not hamper the transportation of the work pieces. If the plant is in the coating operation, the work pieces are transported through the frame.

According to another characteristic of the device according to the invention the frame has the shape of the booth.

In a further development of the device according to the invention, the frame has a groove each on both sides of the suction nozzles, in which the wiper strip can be inserted. This helps to achieve that the wiper strip can always be arranged in the moving direction of the frame behind the suction nozzles.

In addition in the device according to the invention the frame has a transportation suspension, with which the frame can be moved through the booth.

Finally, in the device according to the invention the wiper strip can have a sponge.

In the method according to the invention a wiper strip fixed on the frame can additionally be moved along on the insides of the booth, while the frame is moved through the booth.

In a further development of the method according to the invention, the wiper strip is arranged in the moving direction behind the suction nozzles, before the frame is moved through the booth. As a result the efficiency of the cleaning can be improved further.

The suction devices are installed on a sliding frame in particular, which has slits on the side and a hollow space inside for taking away the sucked air.

Advantageously, in the invention the frame is equipped with sponges for completing the powder removal. These sponges are detachable and can be installed on the frame at two different points. Advantageously, they are to be located in the frame advancing direction behind the suction devices.

BRIEF DESCRIPTION OF THE DRAWINGS

These and other aspects of the invention are apparent from and will be elucidated in details with reference to the embodiments described hereinafter.

DETAILED DESCRIPTION OF THE INVENTION

Figure 1:
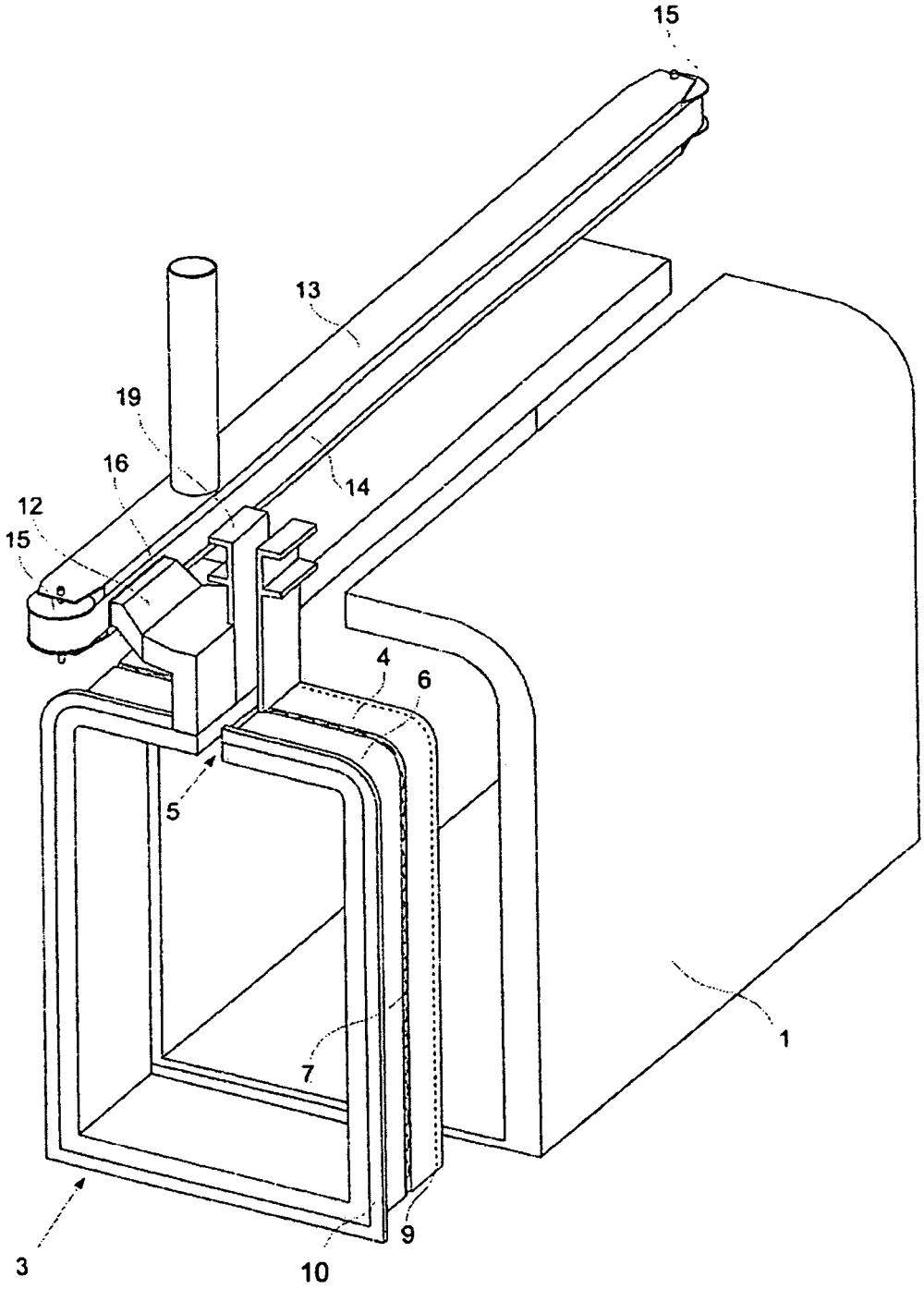
FIG. 1 shows a powder coating booth according to the present invention, in which the cleaning frame is displayed in idle position outside the booth.

As shown in FIG. 1, the powder coating plant includes a booth and a tunnel 1 with open ends respectively. The powder coating plant also includes one or several conventional powder spray pistols, which are however not displayed in FIG. 1. The upper side of the booth is divided in its entire length by a slit 2. Not only the conveyor for the parts to be coated but also the mobile cleaning device, the whole of which is marked with the reference sign 3, runs through this slit 2.

Figure 4:
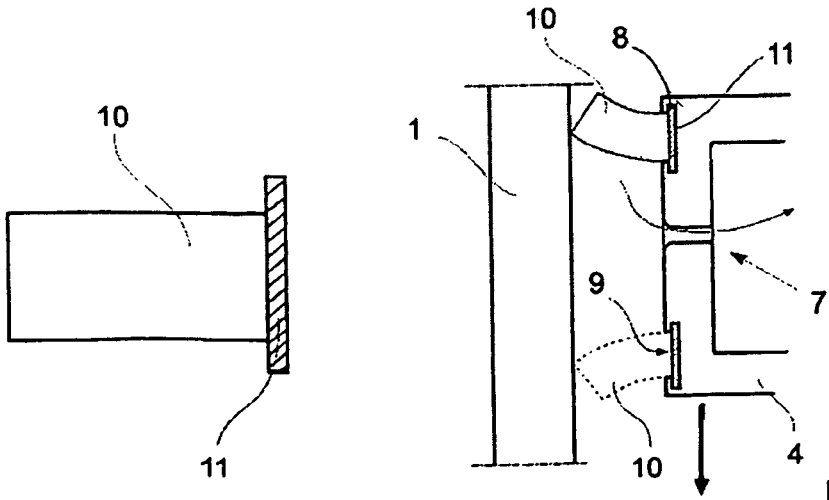
FIG. 4 shows the joining element for fitting the sponge on the mobile frame.

This mobile cleaning device 3 has a frame 4 with a hollow space in the inside for flowing the sucked air. The frame 4 is shaped like the inside profile of the booth 1 and also has an upper opening 5 in order to let the abovementioned conveyor that is not shown here pass unhindered. A slit 7 with oblong suction nozzles is provided on the outside 6 of the frame 4, which is connected to suction devices—these are not shown, because it is a matter of conventional suction devices here—and such slit 7 with oblong suction nozzles generates a type of knife with the sucked air, which is also called air knife in the following, in order that the powder residue into the slit 7 is absorbed especially well. For this, an edge or strip provided on the frame 4 can be helpful for generating a constriction for air streaming through between the wall to be cleaned and the frame and consequently for increasing the flow speed of the air directly on the wall. Two grooves 8 and 9 on the opposite sides of the slit 7 enable a quick fitting of a moist sponge 10 fitted on a flexible supporting strip 11 (FIG. 4). The supporting strip 11 can be inserted into one of the grooves 8 or 9 depending on the moving direction of the frame 4. The sponge 10 moves behind the air knife pressed against the booth walls along these during the cleaning and thus removes the powder residue. The mobile frame 4 hangs up on a bracket 19 and is connected to a suction channel 12, which protrudes from the booth 1 through the opening 2 and enables the airflow from the booth 1 to a suction chamber 13 tightly fit on the booth supporting frame.

Figure 3:
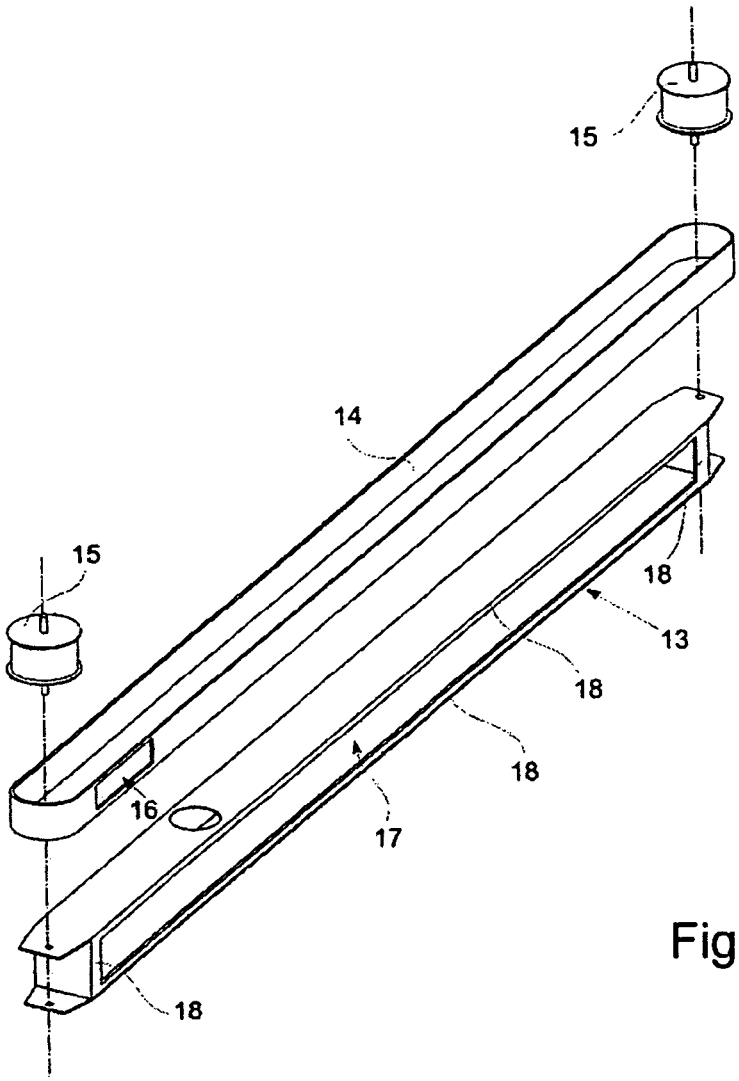
FIG. 3 shows an axonometric exploded view of the essential parts of the stationary suction chamber in the booth from the FIGS. 1 and 2.

As shown in FIG. 3, the suction chamber 13 is box shaped and narrowly built and has two long and two short walls 18 with a slit 17 between it. The slit 17 is as long as the booth. An annular metal band 14 is deflected over belt pulleys or deflection pulleys 15 and sits on the walls 18. A hole 16 is located in the band 14. The suction channel 12 is fixed in the area of the hole 16 on the band 14 and leads into the hole 16. Because of the vacuum, which prevails in the suction chamber 13, the band 14 remains pressed against the sealing edges of the walls 18 provided on the suction chamber 13. The band 14, which runs on the deflection pulleys 15, follows the movements of the mobile cleaning device 3. The band 14 is, as mentioned, connected in the area of the hole 16 over the suction channel 12 with the frame 4 and creates such a connection between the mobile suction means, which are formed by the frame 4 and the suction channel 12 in the present embodiment, and the stationary suction means, which are formed by the suction chamber 13 in the present embodiment. Through this, the air of the mobile suction means can flow to the stationary suction means.

The sealing between the band 14 and the walls 18 takes place due to the vacuum, which generates the suction in the suction chamber 13. Due to the vacuum the band 14 lies always tightly on the border strip of the opening 17.

The cleaning of the powder coating booth takes place quickly and effectively on account of the proposed embodiment. In addition the personnel is no longer exposed to the danger of inhaling the powder, and any environmental pollution is ruled out.

Figure 2:
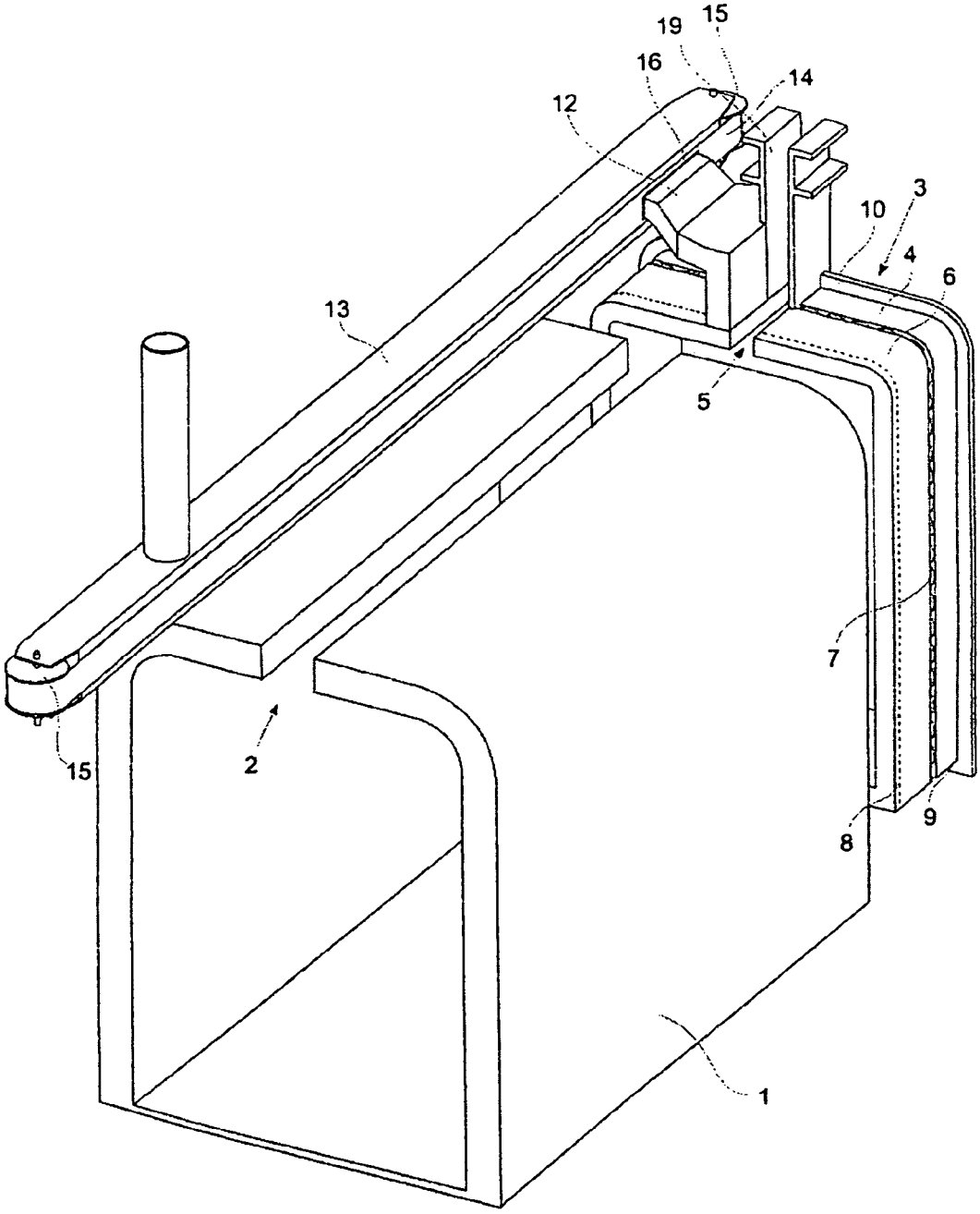
FIG. 2 shows the same powder coating booth from FIG. 1 however with the cleaning frame on the opposite side.

The cleaning takes place on the basis of the sucked air, which carries the powder absorbed through the slit 7 on the mobile frame 4 with itself. The frame 4 moves through the entire booth 1 and sucks off the entire powder residue sticking on the booth walls in one single passage. After the frame 4 has moved through the booth 1, the cleaning process is completed for the present. The frame 4 now remains standing, as is shown in FIG. 2, so long outside the booth 1 until another cleaning process becomes necessary. After the next powder job, a renewed cleaning of the booth 1 takes place by moving back the frame 4 through the booth 1 in order to again occupy the original position shown in FIG. 1. Thereby, by moving the frame 4 only once per cleaning process through the booth 1, time can be saved considerably in contrast to the conventional method, in which the cleaning device moves twice through the booth per cleaning process.

The powder sucked off by the booth walls is transported over the slit 7, the hollow space available inside the frame 4, and the suction channel 12 into the suction chamber 13. From there the powder is led further to a conventional powder recovery plant, where it is filtered and cleaned.

In addition, the cleaning becomes more effective due to the moist sponge on the mobile frame 4. Also possible electrostatic fields, which are caused by friction of the powder particles on each other and on the booth walls, are thus reduced.

The invention is not restricted to the application of sponges 10, which are fitted on the frame 4. In principle, each type of wiper strip, which is suitable, can be used to wipe off the powder residue from the insides of the booth 1.

Because the cleaning takes place through sucking off and not through compressed air bubbles, it is avoided that the powder becomes clumpy through the humidity in the air and becomes difficult to remove. At the approach, the moist sponge 10 is put in the first groove 8 (FIG. 4) and behind the suction respectively.

Before returning in the opposite direction the sponge 10 is taken out of the groove 8 and inserted into the groove 9 on the opposite side of the slit 7. As a result, the sponge 10 works alternately on both the sides, wears off evenly and thus has a longer service life. The sponge 10 can be inserted quickly and simply into the groove 8 and 9 respectively, because it is fitted on a supporting strip 11 made from a flexible material, for example synthetic material or similar. This supporting strip 11 is inserted into one of the grooves 8 or 9 and secures the sponge 10 in its position. Because the sponge 10 is thicker than the gap between the mobile frame 4 and the booth wall, it is pressed flat and bends itself if the frame 4 moves into the booth 1. This guarantees the contact between sponge 10 and the walls at all times. The pistons used in the conventional methods are no longer necessary and that leads to a saving of space among other things. Because the sponge 10 is not exposed to piston stroke on the frame corners, it can consist of one single strip without any danger of tearing off.

The preceding description of the embodiments according to the present invention is used only for illustrative purposes and not for the purpose of restricting the invention. Different alterations and modifications are possible in the framework of the invention without leaving the scope of the invention and its equivalents.

The invention claimed is:

1. A device for cleaning a powder coating booth comprising:

a frame, which is movable along the insides of the booth, and the frame has on an outside surface a plurality of suction nozzles for sucking off the insides of the booth, a stationary suction chamber connected to the frame via a suction channel, and a moveable band with an opening between the stationary suction chamber and the suction channel through which the suction channel is connected to the stationary suction chamber, wherein as the frame moves along the inside of the booth, the opening of the moveable band moves with the frame such that powder sucked from the frame moves through the suction channel and into the stationary suction chamber.

2. A device according to claim 1, wherein the suction nozzles are arranged in such a way and the frame is built in such a way that the air is accelerated directly on the inside of the booth.

3. A device according to claim 1, wherein the frame has a wiper strip.

4. A device according to claim 1, wherein the suction nozzles are arranged on sides of the frame assigned to a ceiling, sidewalls and a bottom of the booth.

5. A device according to claim 1, wherein the frame has a hollow space inside it, which is connected to the suction channel.

6. A device according to claim 1, wherein the frame has a slit at a top of the frame.

7. A device according to claim 1, wherein the frame has a shape corresponding to a shape of the booth.

8. A device according to claim 1, wherein in each case a groove is provided in the frame on both sides of the suction nozzles and the wiper strip can be inserted into such groove.

9. A device according to claim 1, wherein the frame has a transport suspension, through which the frame can be moved through the booth.

10. A device according to claim 3, wherein the wiper strip has a sponge.

11. A device according to claim 1, wherein the plurality of suction nozzles is configured as an air knife to apply suction directly to inside surfaces of the booth for removal of powder from the inside surfaces of the booth.

12. A method for cleaning a powder coating booth with a device having a frame which is movable along the insides of the booth, and the frame has on an outside surface a plurality of suction nozzles for sucking off the insides of the booth, a stationary suction chamber connected to the frame via a suction channel, and a moveable band with an opening between the stationary suction chamber and the suction channel through which the suction channel is connected to the stationary suction chamber, wherein, while the frame is moved through the booth, the air is sucked off through the suction nozzles of the frame and as the frame moves along the inside of the booth, the opening of the moveable band moves with the frame such that powder sucked from the frame moves through the suction channel and into the stationary suction chamber.

13. A method according to claim 12, wherein, while the frame is moved through the booth, a wiper strip is moved along on the insides of the booth.

14. A method according to claim 13, wherein the wiper strip is arranged, in the moving direction behind the suction nozzles, before the frame is moved through the booth.

* * * * *